US005727374A

United States Patent [19]

Fink

[11] Patent Number: 5,727,374

[45] Date of Patent: Mar. 17, 1998

[54] TWISTING SPINDLE, ESPECIALLY FOR A TWO-FOR-ONE TWISTING MACHINE HAVING A PLURALITY OF TWISTING SPINDLES

[75] Inventor: Heinz Fink, Krefeld, Germany

[73] Assignee: Palitex Project-Company GmbH, Krefeld, Germany

[21] Appl. No.: 743,129

[22] Filed: Nov. 1, 1996

[30] Foreign Application Priority Data

Nov. 2, 1995 [DE] Germany ..... 195 40 790.3

[51] Int. Cl.[6] ..... D01H 1/10; D01H 7/86

[52] U.S. Cl. ..... 57/58.86; 57/356

[58] Field of Search ..... 57/58.86, 58.83, 57/58.84, 356, 354; 242/147 M, 150 M

[56] References Cited

U.S. PATENT DOCUMENTS

| | | | |
|---|---|---|---|
| 3,410,071 | 11/1968 | Heimes | 57/58.86 X |
| 4,281,508 | 8/1981 | Frentzel-Beyme | 57/58.86 X |
| 5,155,988 | 10/1992 | Nieratschker | 57/58.86 X |
| 5,487,263 | 1/1996 | Scheufeld et al. | 57/58.86 |

FOREIGN PATENT DOCUMENTS 4408262 10/1994 Germany .

*Primary Examiner*—Daniel P. Stodola
*Assistant Examiner*—Tina R. Taylor
*Attorney, Agent, or Firm*—Robert W. Becker & Associates

[57] ABSTRACT

A twisting spindle, such as a two-for-one twisting spindle, has a spindle rotor and a spool carrier with a hollow hub mounted on the spindle rotor. A yarn brake positioned within the hollow hub has a brake cartridge positioned vertically in the cylindrical housing. It includes two brake rings positioned at opposite ends of the brake cartridge. A first brake ring is axially displaceable for adjusting a braking force. The yarn brake includes an adjusting sleeve axially displaceable and rotationally fixed in the cylindrical housing. The lower end of the adjusting sleeve has a threaded portion extending axially into the area beneath the spool carrier. A transmission member including a radial actuating arm threaded onto the threaded portion of the adjusting sleeve so as to be rotatable but axially fixed. The actuating arm has a first permanent magnet located at a radially outer end of the actuating arm and positioned within an area delimited by the yarn balloon closely adjacent thereto. A second permanent magnet is positioned external to the area delimited by the yarn balloon directly opposite the first permanent magnet. The facing sides of the two permanent magnets have opposite polarity. The second permanent magnet is rotatable about the central axis along a circular arc with a guide system. A centrally controlled mechanical actuator for displacing the second permanent magnet along the circular arc for a predetermined angular distance is provided.

17 Claims, 3 Drawing Sheets

TWISTING SPINDLE, ESPECIALLY FOR A TWO-FOR-ONE TWISTING MACHINE HAVING A PLURALITY OF TWISTING SPINDLES

BACKGROUND OF THE INVENTION

The present invention relates to a twisting spindle, especially a twisting spindle for a two-for-one twisting machine comprising a plurality of twisting spindles, wherein the twisting spindle comprises a spool carrier with a hollow hub and a spindle rotor positioned directly below the spool carrier. During operation of the twisting spindle, the yarn entering axially into the hollow hub is radially outwardly guided after exiting from the spindle rotor under formation of a yarn balloon surrounding the spool carrier and is then guided to a centering point which is positioned above the spool carrier. The twisting spindle further comprises a yarn brake positioned within the hollow hub of the spool carrier which comprises a brake cartridge supported in the axial direction by brake rings positioned one atop the other within a cylindrical housing. By axially displacing one of the brake rings, different braking forces can be adjusted.

Twisting spindles comprising a yarn brake which are adjustable by a central control device to have different braking force values, are known in general. Such a device in which the twisting spindle and the capsule yarn brake (i.e., a yarn brake with brake cartridge) have the features disclosed above is, for example, known from German Offenlegungsschrift 44 08 262.

In the known device the central control of the capsule yarn brake is provided by a pneumatic control device via a compressed air line and a compressed air cylinder coupled to one of the brake rings.

It is an object of the present invention to provide a central control of capsule yarn brake of a plurality of twisting spindle of the aforementioned kind with mechanical means, thus replacing the use of compressed air. This object faces the problem that a simple mechanical access to the interior of the twisting spindle in which the capsule yarn brake is arranged is obstructed by the yarn balloon surrounding the spool carrier during operation.

SUMMARY OF THE INVENTION

The twisting spindle according to the present invention is primarily characterized by:

A spindle rotor;

A spool carrier, having a hollow hub with a central axis, mounted on the spindle rotor for receiving a yarn spool, wherein during operation of the twisting spindle a yarn removed from the yarn spool is guided axially along the center axis through the hollow hub and radially through the spindle rotor and, after exiting from the spindle rotor and forming a yarn balloon surrounding the spool carrier, is guided to a centering point above the spindle carrier;

A yarn brake positioned within the hollow hub, the hollow hub forming a cylindrical housing for the yarn brake;

The yarn brake comprising a brake cartridge positioned vertically along the central axis within the cylindrical housing and further comprising a first and a second brake rings positioned at opposite ends of the brake cartridge for supporting the brake cartridge, the first brake ring positioned axially above the second brake ring;

One of the first and second brake rings being axially displaceable within the cylindrical housing to thereby adjust a braking force of the yarn brake;

The yarn brake further comprising an adjusting sleeve having an upper end and a lower end, positioned in the cylindrical housing so as to be axially displaceable and rotationally fixed relative to the cylindrical housing and enclosing the second brake ring;

The first brake ring non-positively coupled, at least in one axial direction, to the upper end of the adjusting sleeve;

The lower end of the adjusting sleeve comprising a threaded portion extending axially into the area beneath the spool carrier;

A transmission member, comprising an actuating arm extending radially relative to the central axis, threaded onto the threaded portion of the adjusting sleeve so as to be rotatable but axially fixed;

The actuating arm comprising a first permanent magnet located at a radially outer end of the actuating arm, wherein an outwardly facing face of the first permanent magnet is positioned within the area delimited by the yarn balloon closely adjacent to the rotating yarn forming the yarn balloon;

A second permanent magnet positioned external to the area delimited by the yarn balloon directly opposite the first permanent magnet, wherein the outwardly facing face of the first magnet and an inwardly facing face of the second permanent magnet have opposite polarity;

The second permanent magnet being rotatable about the central axis along a circular arc;

A guide system for guiding the second permanent magnet along the circular arc;

A centrally controlled mechanical actuator for displacing the second permanent magnet along the circular arc for a predetermined angular distance.

Advantageously, the yarn brake further comprises a first brake ring carrier for supporting the first brake ring, the first brake ring carrier axially displaceable within the cylindrical housing and fixedly connected to the upper end of the adjusting sleeve.

Preferably, the twisting spindle further comprises an inner member, positioned coaxially within the adjusting sleeve, wherein the adjusting sleeve and the inner member are connected to one another by at least one tongue-and-groove connection for axially guiding and rotationally fixing the adjusting sleeve.

Preferably, the inner member comprises a guide sleeve positioned at an upper end thereof. The yarn brake further comprises a second brake ring carrier for supporting the second brake ring. The second brake ring carrier comprises a spring and is supported within the guide sleeve with the spring. The second brake ring carrier is axially downwardly displaceable against the force of the spring within the guide sleeve. The guide sleeve has an upper annular abutment for limiting the upward axial movement of the second brake ring carrier.

Preferably, the tongue-and-groove connection is located at the exterior of the guide sleeve.

Preferably, the spool carrier is a spool pot with an outer wall and a bottom and the transmission member and the actuating arm are arranged within the bottom.

The first permanent magnet is preferably positioned within the spool pot directly adjacent to the outer wall.

Preferably, the outer wall has a cutout and the first permanent magnet is aligned with the cutout.

Advantageously, the guide system comprises a guide rail with a circular arc-shaped guide groove and the second permanent magnet comprises a guide pin engaging the guide groove.

Preferably, the twisting spindle further comprises a balloon limiter surrounding the spool carrier. The the balloon limiter has an exterior wall, and the guide rail is connected to the exterior wall.

Expediently, the mechanical actuator is an elongate push-rod guided in a horizontal plane and displaceable in a longitudinal direction thereof. The guide system further comprises a transverse pin connected to the push rod so as to be displaceable in the horizontal plane perpendicular to the push rod. The guide system also comprises a holder for the permanent magnet. The transverse pin is pivotably connected to the holder. The guide pin is attached to the holder.

The twisting spindle preferably further comprises a securing element for connecting the transverse pin to the push rod. The securing element comprises two bores extending perpendicular to one another, wherein in a first one of the two bores the push rod is fixedly secured and in a second one of the two bores the transverse pin is slidably guided.

The present invention also relates to a two-for-one twisting machine comprising a plurality of twisting spindles, wherein the twisting spindles each are comprised of:

a) A spindle rotor;

b) A spool carrier, having a hollow hub with a central axis, mounted on the spindle rotor for receiving a yarn spool, wherein during operation of the twisting spindle a yarn removed from the yarn spool is guided axially along the center axis through the hollow hub and radially through the spindle rotor and, after exiting from the spindle rotor and forming a yarn balloon surrounding the spool carrier, is guided to a centering point above the spindle carrier;

c) A yarn brake positioned within the hollow hub, the hollow hub forming a cylindrical housing for the yarn brake;

d) The yarn brake comprises a brake cartridge positioned vertically along the central axis within the cylindrical housing and further comprising a first and a second brake rings positioned at opposite ends of the brake cartridge for supporting the brake cartridge, the first brake ring positioned axially above the second brake ring;

e) One of the first and second brake rings being axially displaceable within the cylindrical housing to thereby adjust a braking force of the yarn brake;

f) The yarn brake further comprising an adjusting sleeve, having an upper end and a lower end, positioned in the cylindrical housing so as to be axially displaceable and rotationally fixed relative to the cylindrical housing and enclosing the second brake ring;

g) The first brake ring nonpositively coupled, at least in one axial direction, to the upper end of the adjusting sleeve;

h) The lower end of the adjusting sleeve comprising a threaded portion extending axially into the area beneath the spool carrier;

i) A transmission member, comprising an actuating arm extending radially relative to the central axis, threaded onto the threaded portion of the adjusting sleeve so as to be rotatable but axially fixed;

j) The actuating arm comprising a first permanent magnet located at a radially outer end of the actuating arm, wherein an outwardly facing face of the first permanent magnet is positioned within an area delimited by the yarn balloon closely adjacent to the rotating yarn forming the yarn balloon;

k) A second permanent magnet positioned external to the area delimited by the yarn balloon directly opposite the first permanent magnet, wherein the outwardly facing phase of the first permanent magnet and an inwardly facing face of the second permanent magnet have opposite polarity;

l) The second permanent magnet being rotatable about the central axis along a circular arc;

m) A guide system for guiding the second permanent magnet along the circular arc;

Further comprising a centrally controlled, mechanical actuator for displacing simultaneously the second permanent magnet of the twisting spindles along the circular arc for a predetermined angular distance.

Advantageously, each one of the guide systems comprises a guide rail with a circular arc-shaped guide groove and the second permanent magnet comprises a guide pin engaging the guide groove.

Preferably, each one of the twisting spindles further comprises a balloon limiter surrounding the spool carrier, the balloon limiter having an exterior wall and the guide rail connected to the exterior wall.

Advantageously, the mechanical actuator is an elongate push rod guided in a horizontal plane and displaceable in a longitudinal direction thereof. Each guide system further comprises a transverse pin connected to the push rod so as to be displaceable in the horizontal plane perpendicular to the push rod. Each guide system further comprises a holder for the permanent magnet. The transverse pins are pivotably connected to the holders. The guide pins are attached to the holders.

Expediently, each one of the guide systems further comprises a securing element for connecting the transverse pin to the push rod, the securing element comprising two bores extending perpendicular to one another, wherein in a first one of the two bores the push rod is fixedly secured and in a second one of the two bores the transverse pin is slidably guided.

The invention is based on the principle that a control of the yarn brake within each of the individual twisting spindles with the aid of a central control device, especially a control reaching into an area which is closely adjacent to the yarn balloon, is performed with purely mechanical means. The area in which the yarn balloon is present is bridged with a magnetic field, and, finally, within the spaced delimited by the yarn balloon the control process is again performed with purely mechanical means for adjusting the force of the yarn brake. Bridging of the area exterior to the yarn balloon and the area within the yarn balloon by magnetic means is achieved with two permanent magnets, whereby the externally arranged permanent magnet can be rotated about the axis of the twisting spindle. This rotation is transmitted via the magnetic field onto the internally positioned permanent magnet which is thus entrained and pivoted. The pivoting movement of the internal permanent magnet results in a rotational movement which is transformed with a helical gear arranged at the central axis of the spindle into a linear movement extending parallel to the central axis of the spindle causing the displacement of one of the two brake rings of the yarn brake.

It has been proven to be advantageous when for the adjustment of the braking force an adjustment of the upper brake ring is performed, as is known from prior art devices. The inventive twisting spindle is primarily suitable for use in conjunction with large two-for-one twisting machines comprising a plurality of twisting spindles arranged preferably alongside the two long machine sides in which via the magnetic-mechanically operating control device the yarn brakes of the twisting spindles of one designated machine field, or of the entire machine side, can be simultaneously performed by the central control device.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 3.

Figure 1:
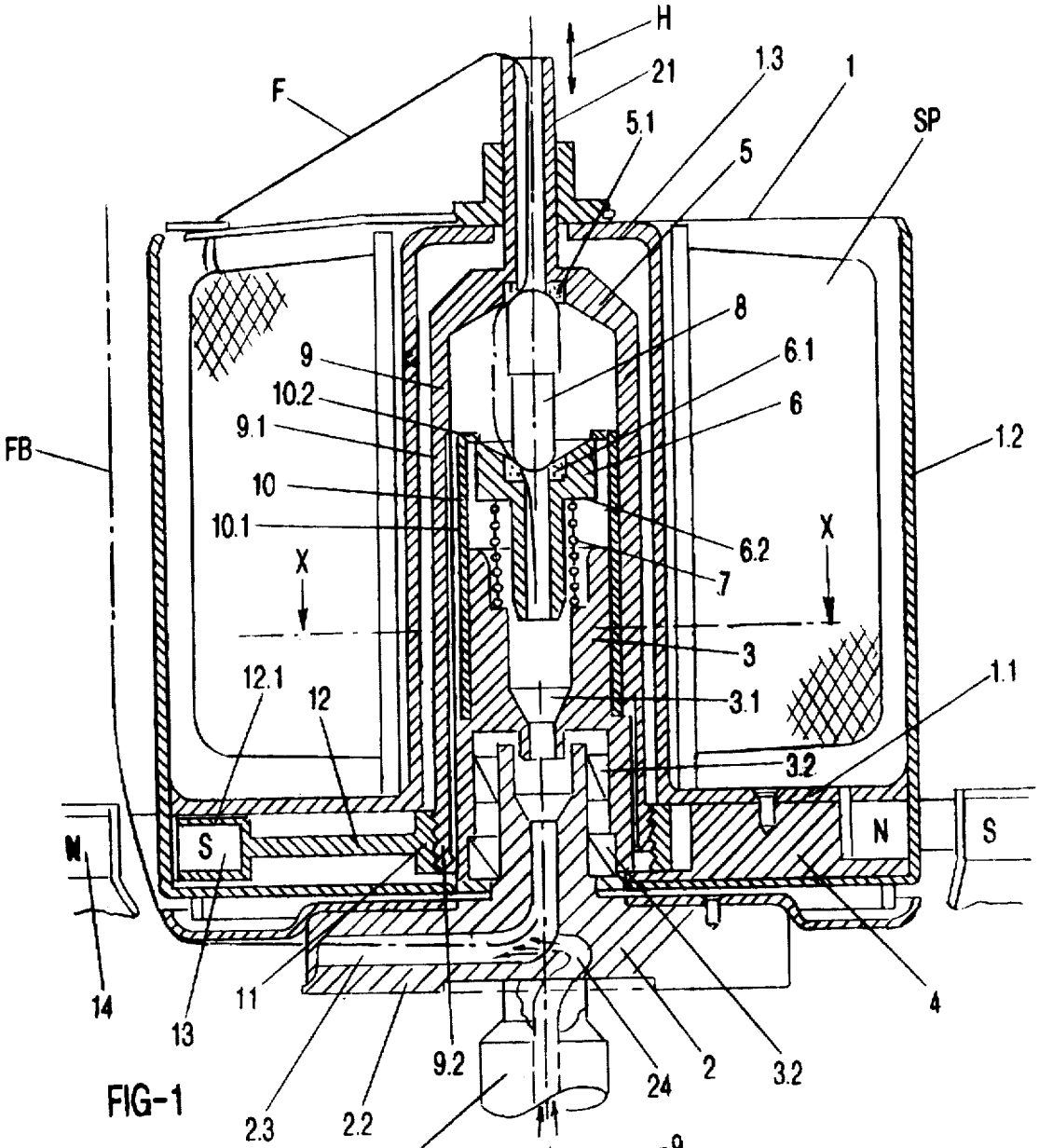
FIG. 1 shows a vertical section of a two-for-one twisting spindle with a yarn brake.
Figure 1A:
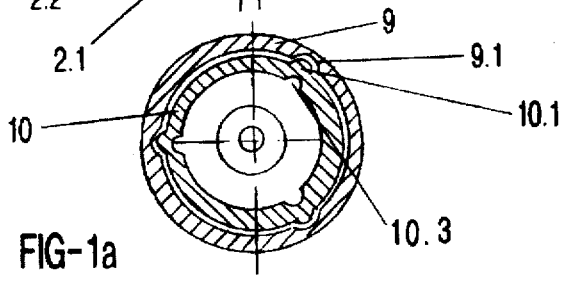
FIG. 1*a* shows a section of the hollow hub of the twisting spindle of FIG. 1 according to line X—X.
Figure 2:
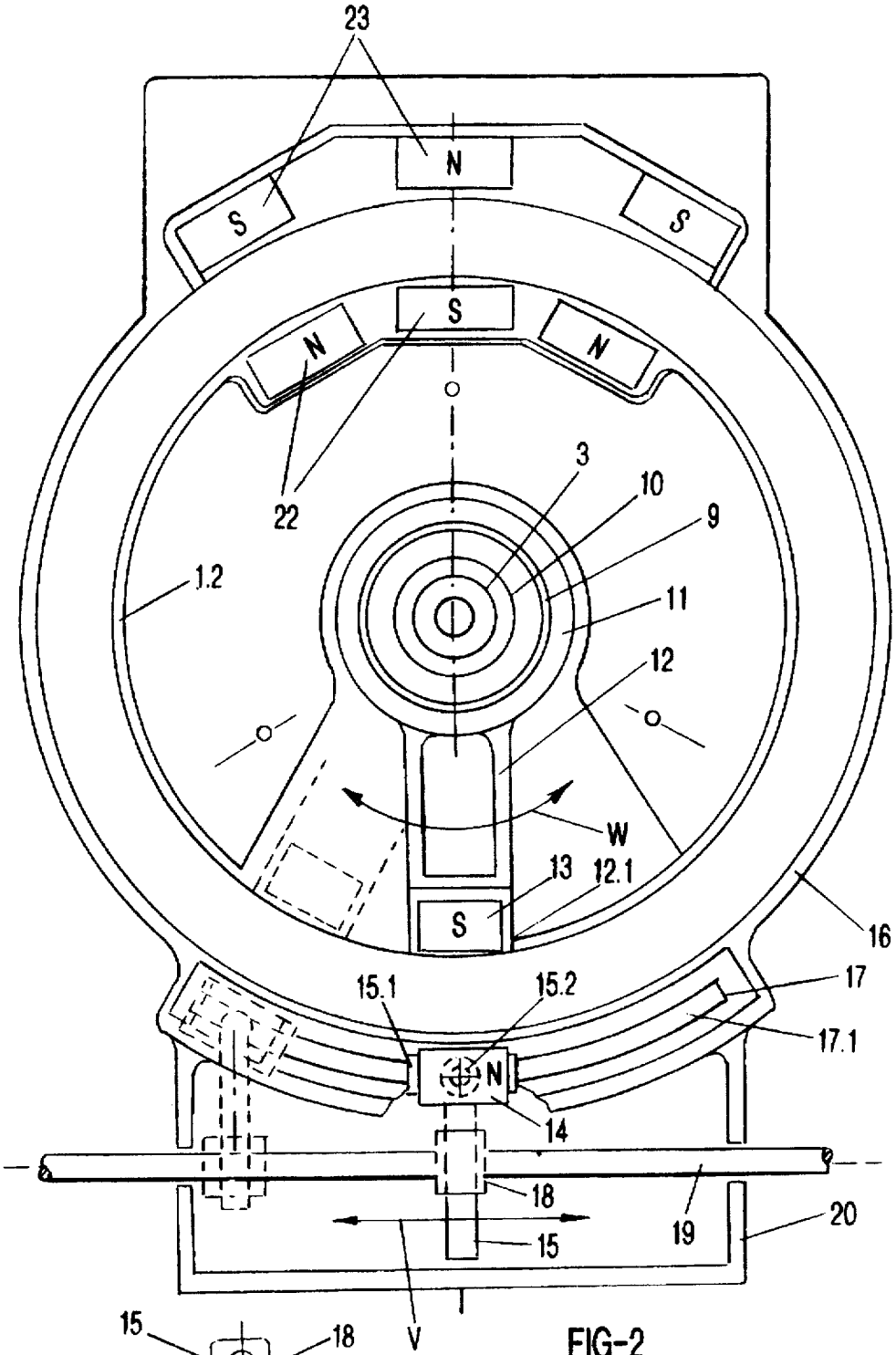
FIG. 2 shows a plan view of the twisting spindle of FIG. 1.
Figure 3:
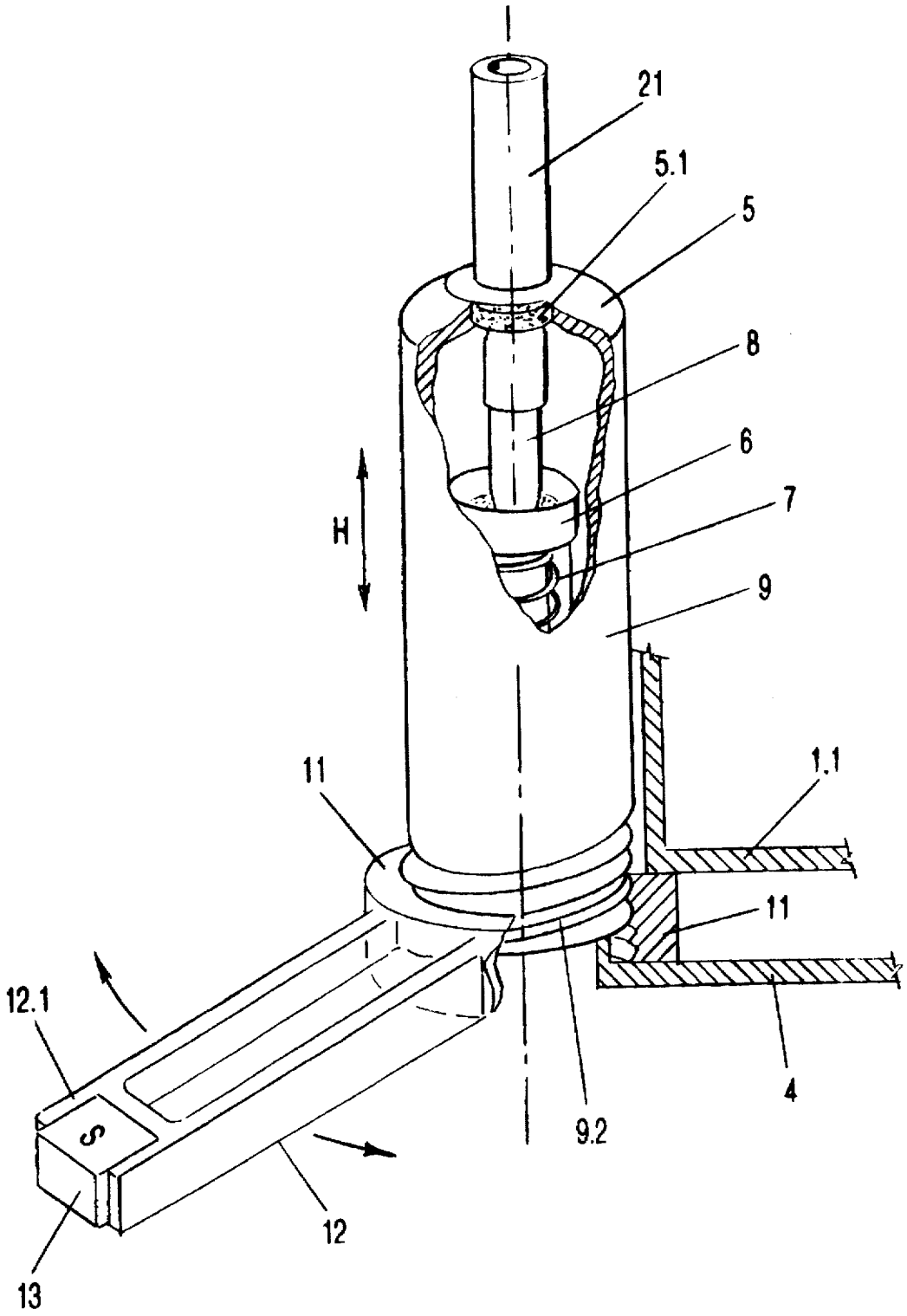
FIG. 3 shows in a perspective, partly sectional view the hollow hub of the twisting spindle of FIGS. 1 and 2 with the helical gear for generating the displacement movement of the upper brake ring.

In FIGS. 1 and 2 the parts of a two-for-one twisting spindle that are primarily important for the following discussion of the yarn brake and its control are shown. Parts of the twisting spindle that are not necessary for this discussion have been omitted entirely or are indicated only schematically.

The represented two-for-one twisting spindle can be arranged together with other two-for-one twisting spindles of the same design on a spindle frame of a twisting machine in a manner known per se and not shown in the drawings.

The two-for-one twisting spindle comprises a spool carrier 1 with a spool carrier bottom 1.1, a protective pot with external wall 1.2 and a hollow hub 1.3 on which a supply spool SP is arranged from which two yarns F are removed in the manner illustrated and guided into the yarn inlet tube 21 of the hollow spindle axle and further guided through the yarn brake which will be explained in detail in the following. Below the protective pot 1 the spindle rotor 2 is arranged with its drive whorl 2.1, a yarn storage disk 2.2, and a radially oriented yarn guide channel 2.3 from where the yarns, after exiting, are guided between the protective pot exterior wall 1.2 and a balloon limiter 16 during operation under formation of a yarn balloon FB in the upward direction to a non-represented centering point (eye). The spindle rotor 2 is supported with rotary bearings 3.2 at the stationary inner member 3 within the hollow hub 1.3. The inner member 3 is connected to the bottom part 4 which, in turn, is positioned stationarily below the spool carrier bottom 1.1. This bottom part 4 and with it the inner member 3 are stationary and fixed against rotation by a device which comprises permanent magnets 22 positioned within the bottom part 4 and having oppositely arranged permanent magnets 23 of opposite polarity which are fixedly connected to the balloon limiter 16.

The hollow hub 1.3 forms simultaneously the exterior housing of the yarn brake. The yarn brake comprises an upper yarn ring carrier 5 to which is connected a brake ring 5.1. The incoming yarn is guided through brake ring 5.1. At the upper side of the brake ring carrier 5 a yarn guide tube 21 is arranged which extends upwardly through an opening of the housing 1.3. The upper brake ring carrier 5 has oppositely arranged thereto a lower brake ring carrier 6 comprising a brake ring 6.1 through which the yarn exits from the yarn brake. Between the two brake rings 5.1 and 6.1 a brake cartridge 8 is positioned and supported. The brake cartridge 8, as is conventional, is comprised of two telescopic sleeve parts that are displaceable relative to one another against the force of a spring. The lower brake ring carrier 6 is arranged within a guide sleeve 10 so as to be displaceable against the force of a pressure spring 7, whereby the guide sleeve 10 is fixedly connected by a tongue-and-groove connection 10.3 with the inner member 3 of the spool carrier hub. At the upper end of the guide sleeve 10 an inwardly projecting abutment ring 10.2 is arranged which limits the upward movement of the lower brake ring carrier 6 caused by the force of the pressure spring 7. Furthermore, the lower brake ring carrier 6 is in the form of a compressed air piston. When within the through channel 3.1 of the inner member 3 a vacuum is generated, for example, by activating the injector 24 arranged at the spindle rotor 2, the lower brake ring carrier 6 is moved downwardly which results in the brake cartridge 8 being released from the brake ring 6.1. The brake cartridge 8 is secured by a non-represented support ring in a position such that the yarn entering through the yarn inlet tube 21 can be guided alongside the brake cartridge 8 under the effect of the vacuum through the inlet channel 3.1 into the spindle rotor 2 and through the yarn storage disk 2.2. Such a threading arrangement is known and, for example, disclosed in German patent 32 43 157.

At the exterior of the upper brake ring carrier 5 an adjusting sleeve 9 is arranged so as to be nonrotable but displaceable in the axial direction within the housing 1.3 together with the upper brake ring carrier 5. For the non-rotatable axial guiding of the adjusting sleeve 9 at least one guide groove 9.1 is provided at its inner side which is engaged by a guide rib 10.1 extending in the axial direction at the exterior of the guide sleeve 10. The adjusting sleeve 9 extends coaxially to the central axis of the spindle in the downward direction between the housing 1.3 and the guide sleeve 10/the inner member 3 into the area of the bottom part 4 below the bottom 1.1 of the spool carrier. It comprises a lower end 9.2 provided with an outer thread. Onto this outer thread a transmission member 11 with an inner thread is threaded. The transmission member 11 is supported so as to be rotatable but axially fixed at the bottom part 4. An actuating arm 12 is provided thereat which extends radially to the central axis and, at its outer end, is provided with a holder 12.1 for a first permanent magnet 13. The outer side of the magnet 13 is positioned directly behind the exterior wall 1.2 of the spool pot. The transmission member 11 forms together with the lower end 9.2 of the adjusting sleeve 9 a helical gear. When, with a corresponding rotation of the actuating arm 12 in the direction of arrow W (FIG. 2), the transmission member 11 is rotated, the adjusting sleeve 9 is lifted or lowered, depending on the direction of rotation, and the brake ring 5.1 supported at the upper brake ring carrier 5 is thus also lifted or lowered in the direction of arrow H (FIG. 1).

The actuation of the actuating arm 12 is carried out with a device external to the balloon limiter and thus external to the yarn balloon FB formed by the yarn exiting from the spindle. This device will be disclosed in more detail in the following.

As can be seen especially in FIG. 2, at the exterior of the balloon limiter 16 a guide rail 17 with a circular arc-shaped guide groove 17.1 is arranged which extends over a predetermined angular distance relative to the spindle axle. On the guide rail 17 travels a holder 15.1 engaging with a guide pin 15.2 the groove 17.1. The holder 15.1 has arranged therein a second permanent magnet 14. The arrangement, with respect to the axial height and the pivot range of the actuating arm 12, is designed such that the second permanent magnet 14 can be moved into a position in which it is directly positioned opposite the first permanent magnet 13 whereby this arrangement of the two permanent magnets in their holders is such that the facing sides have opposite magnetic polarity. This results in the first permanent magnet 13 with its holder 12.1 following the movement of the second permanent magnet 14 when the holder 15.1 is moved along the guide rail 17. This movement is transmitted via the actuating arm 12 onto the transmission member 11 and results in an axial displacement of the adjusting sleeve 9 and thus in the aforedescribed axial movement of the brake ring 5.1 at the inlet to the yarn brake. In this manner, the braking force of the yarn brake can be adjusted.

Figure 2A:
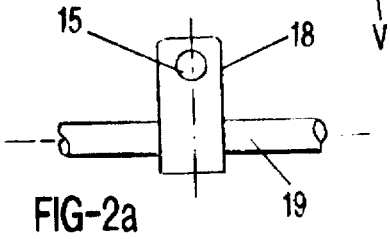
FIG. 2*a* shows a partial side view of the twisting spindle of FIG. 2 in the area of the holder between the push rod and the transverse pin.

The displacement of the holder 15.1 with the second permanent magnet 14 can be performed with a mechanical actuating device which may comprise a push rod 19 guided with a guide 20 in a horizontal plane and displaceable in its longitudinal direction along the non-represented spindle frame of the twisting machine. At each one of the twisting spindles, a transverse pin 15 is provided which is connected to the push rod 19. It is displaceable in a horizontal plane perpendicularly to the push rod 19. The transverse pin 15 is pivotably connected to the holder 15.1 of the second permanent magnet 14. As a securing element between the push rod 19 and the transverse pin 15 a holder 18 may be provided which is represented in more detail in FIG. 2*a*. It comprises two bores extending at an angle of 90° relative to one another whereby in one of the bores the push rod 19 is fixedly arranged while in the other bore the pin 15 is slidably guided. Upon a longitudinal displacement of the push rod 19, all of the securing elements 18 arranged thereat are displaced in the direction of arrow V which results in each holder 15.1 with corresponding permanent magnet 14 being displaced over a certain pivoting range along the guide rail 17 so that the pin 15 glides correspondingly within the securing element 18. FIG. 2 shows a possible end position of the securing element 18 and holder 15.1 in dashed lines together with a corresponding position of the actuating arm 12 with the first permanent magnet 13.

It is obvious that a corresponding displacement of the push rod 19 can centrally control a displacement of all yarn brakes. The aforedescribed magnetic/mechanic actuating device is connected with the push rod 19 to such a central control unit. The push rod 19 may extend at least over a portion of the longitudinal side of the two-for-one twisting machine so that the yarn brakes of all or a portion of the twisting spindles arranged at this longitudinal machine side can be simultaneously centrally adjusted.

Of course, it is also possible to provide other mechanical or electro-mechanical actuating devices for guiding the holder 15.1 carrying the second permanent magnet 14.

The present invention is, of course, in no way restricted to the specific disclosure of the specification and drawings, but also encompasses any modifications within the scope of the appended claims.

What I claim is:

1. A twisting spindle comprising:

a spindle rotor;

a spool carrier, having a hollow hub with a central axis, mounted on said spindle rotor for receiving a yarn spool, wherein during operation of said twisting spindle yarn removed from the yarn spool is guided axially along said center axis through said hollow hub and radially through said spindle rotor and, after exiting from said spindle rotor and forming a yarn balloon surrounding said spool carrier, is guided to a centering point above said spindle carrier;

a yarn brake positioned within said hollow hub, said hollow hub forming a cylindrical housing for said yarn brake;

said yarn brake comprising a brake cartridge positioned vertically along said central axis within said cylindrical housing and further comprising a first and a second brake rings positioned at opposite ends of said brake cartridge for supporting said brake cartridge, said first brake ring positioned axially above said second brake ring;

one of said first and second brake rings being axially displaceable within said cylindrical housing to thereby adjust a braking force of said yarn brake;

said yarn brake further comprising an adjusting sleeve, having an upper end and a lower end, positioned in said cylindrical housing so as to be axially displaceable and rotationally fixed relative to said cylindrical housing and enclosing said second brake ring;

said first brake ring nonpositively coupled, at least in one axial direction, to said upper end of said adjusting sleeve;

said lower end of said adjusting sleeve comprising a threaded portion extending axially into an area beneath said spool carrier;

a transmission member, comprising an actuating arm extending radially relative to said central axis, threaded onto said threaded portion of said adjusting sleeve so as to be rotatable but axially fixed;

said actuating arm comprising a first permanent magnet located at a radially outer end of said actuating arm, wherein an outwardly facing face of said first permanent magnet is positioned within an area delimited by the yarn balloon closely adjacent to the rotating yarn forming the yarn balloon;

a second permanent magnet positioned external to said area delimited by said yarn balloon directly opposite said first permanent magnet, wherein said outwardly facing face of said first permanent magnet and an inwardly facing face of said second permanent magnet have opposite polarity;

said second permanent magnet being rotatable about said central axis along a circular arc;

a guide system for guiding said second permanent magnet along the circular arc;

a centrally controlled mechanical actuator for displacing said second permanent magnet along said circular arc for a predetermined angular distance.

2. A twisting spindle according to claim 1, wherein said yarn brake further comprises a first brake ring carrier for supporting said first brake ring, said first brake ring carrier axially displaceable within said cylindrical housing and fixedly connected to said upper end of said adjusting sleeve.

3. A twisting spindle according to claim 2, further comprising an inner member positioned coaxially within said adjusting sleeve, wherein said adjusting sleeve and said inner member are connected to one another by at least one tongue-and-groove connection for axially guiding and rotationally fixing said adjusting sleeve.

4. A twisting spindle according to claim 3, wherein:

said inner member comprises a guide sleeve positioned at an upper end thereof;

said yarn brake further comprises a second brake ring carrier for supporting said second brake ring;

said second brake ring carrier comprises a spring and is supported within said guide sleeve with said spring;

said second brake ring carrier being axially downwardly displaceable against a force of said spring within said guide sleeve;

said guide sleeve having an upper annular abutment for limiting an upward axial movement of said second brake ring carrier.

5. A twisting spindle according to claim 4, wherein said tongue-and-groove connection is located at the exterior of said guide sleeve.

6. A twisting spindle according to claim 1, wherein said spool carrier is a spool pot with an outer wall and a bottom and wherein said transmission member and said actuating arm are arranged within said bottom.

7. A twisting spindle according to claim 6, wherein said first permanent magnet is positioned within said spool pot directly adjacent to said outer wall.

8. A twisting spindle according to claim 7, wherein said outer wall has a cutout and wherein said first permanent magnet is aligned with said cutout.

9. A twisting spindle according to claim 1, wherein said guide system comprises a guide rail with a circular arc-shaped guide groove and wherein said second permanent magnet comprises a guide pin engaging said guide groove.

10. A twisting spindle according to claim 9, further comprising a balloon limiter surrounding said spool carrier, said balloon limiter having an exterior wall and said guide rail being connected to said exterior wall.

11. A twisting spindle according to claim 9, wherein:

said mechanical actuator is an elongate push rod guided in a horizontal plane and displaceable in a longitudinal direction thereof;

said guide system further comprises a transverse pin connected to said push rod so as to be displaceable in said horizontal plane perpendicular to said push rod;

said guide system further comprising a holder for said permanent magnet;

said transverse pin is pivotably connected to said holder; and said guide pin is attached to said holder.

12. A twisting spindle according to claim 11, further comprising a securing element for connecting said transverse pin to said push rod, said securing element comprising two bores extending perpendicular to one another, wherein in a first one of said two bores said push rod is fixedly secured and in a second one of said two bores said transverse pin is slidably guided.

13. A two-for-one twisting machine comprising a plurality of twisting spindles, each one of said twisting spindles comprising:

a) a spindle rotor;

b) a spool carrier, having a hollow hub with a central axis, mounted on said spindle rotor for receiving a yarn spool, wherein during operation of said twisting spindle a yarn removed from the yarn spool is guided axially along said center axis through said hollow hub and radially through said spindle rotor and, after exiting from said spindle rotor and forming a yarn balloon surrounding said spool carrier, is guided axially to a centering point above said spindle carrier;

c) a yarn brake positioned within said hollow hub, said hollow hub forming a cylindrical housing for said yarn brake;

d) said yarn brake comprising a brake cartridge positioned vertically along said central axis within said cylindrical housing and further comprising a first and a second brake rings positioned at opposite ends of said brake cartridge for supporting said brake cartridge, said first brake ring positioned axially above said second brake ring;

e) one of said first and second brake rings being axially displaceable within said cylindrical housing to thereby adjust a braking force of said yarn brake;

f) said yarn brake further comprising an adjusting sleeve, having an upper end and a lower end, positioned in said cylindrical housing so as to be axially displaceable and rotationally fixed relative to said cylindrical housing and enclosing said second brake ring;

g) said first brake ring nonpositively coupled, at least in one axial direction, to said upper end of said adjusting sleeve;

h) said lower end of said adjusting sleeve comprising a threaded portion extending axially into an area beneath said spool carrier;

i) a transmission member, comprising an actuating arm extending radially relative to said central axis, threaded onto said threaded portion of said adjusting sleeve so as to be rotatable but axially fixed;

j) said actuating arm comprising a first permanent magnet located at a radially outer end of said actuating arm, wherein an outwardly facing face of said first permanent magnet is positioned within an area delimited by the yarn balloon closely adjacent to the rotating yarn forming the yarn balloon;

k) a second permanent magnet positioned external to said area delimited by said yarn balloon directly opposite said first permanent magnet, wherein said outwardly facing face of said first permanent magnet and an inwardly facing face of said second permanent magnet have opposite polarity;

l) said second permanent magnet being rotatable about said central axis along a circular arc;

m) a guide system for guiding said second permanent magnet along the circular arc;

further comprising a centrally controlled, mechanical actuator for displacing simultaneously said second permanent magnets of said twisting spindles along said circular arc for a predetermined angular distance.

14. A two-for-one twisting machine according to claim 13, wherein each one of said guide systems comprises a guide rail with a circular arc-shaped guide groove and wherein said second permanent magnet comprises a guide pin engaging said guide groove.

15. A two-for-one twisting machine according to claim 14, wherein each one of said twisting spindles further comprises a balloon limiter surrounding said spool carrier, said balloon limiter having an exterior wall and said guide rail connected to said exterior wall.

16. A two-for-one twisting spindle according to claim 14, wherein:

said mechanical actuator is an elongate push rod guided in a horizontal plane and displaceable in a longitudinal direction thereof;

said guide systems each further comprise a transverse pin connected to said push rod so as to be displaceable in said horizontal plane perpendicular to said push rod;

said guide systems each further comprise a holder for said permanent magnet;

said transverse pins are pivotably connected to said holders; and said guide pins are fixedly connected to said holders.

17. A two-for-one twisting machine according to claim 16, wherein each one of said guide systems further comprises a securing element 18 for connecting said transverse pin to said push rod, said securing element comprising two bores extending perpendicular to one another in different planes, wherein in a first one of said two bores said push rod is fixedly secured and in a second one of said two bores said transverse pin is slidably guided.

* * * * *